United States Patent [19]

Idota et al.

[11] Patent Number: 4,624,911

[45] Date of Patent: Nov. 25, 1986

[54] SILVER HALIDE DIFFUSION TRANSFER USING PLURAL CYCLIC IMIDE SILVER HALIDE SOLVENTS

[75] Inventors: Yoshio Idota; Morio Yagihara, both of Kanagawa, Japan

[73] Assignee: Fuji Photo Film Co., Ltd., Kanagawa, Japan

[21] Appl. No.: 706,532

[22] Filed: Feb. 27, 1985

[30] Foreign Application Priority Data

Feb. 27, 1984 [JP] Japan ..... 59-35738

[51] Int. Cl.[4] ..... G03C 5/54; G03C 5/38

[52] U.S. Cl. ..... 430/251; 430/233; 430/248; 430/459

[58] Field of Search ..... 430/251, 233, 248, 455, 430/428, 459

[56] References Cited

U.S. PATENT DOCUMENTS

| | | | |
|---|---|---|---|
| 2,857,274 | 10/1958 | Land et al. | 430/251 |
| 2,857,276 | 10/1958 | Land et al. | 430/251 |
| 4,126,459 | 11/1978 | Greenwald | 430/251 |
| 4,150,228 | 4/1979 | Greenwald | 430/455 |
| 4,168,166 | 9/1979 | Land | 430/251 |
| 4,297,430 | 10/1981 | Kanada et al. | 430/251 |

*Primary Examiner*—Richard L. Schilling
*Attorney, Agent, or Firm*—Sughrue, Mion, Zinn, Macpeak & Seas

[57] ABSTRACT

A method for image formation by a diffusion transfer process including developing an imagewise light-exposed light-sensitive silver halide emulsion layer in the presence of a developing agent, a silver halide solvent and an alkali, wherein at least two cyclic imide compounds represented by the formula:

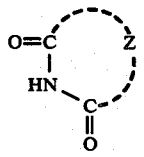

(I)

wherein Z represents an atomic group necessary to form a 5- or 6-membered imido ring containing from 1 to 3 nitrogen atoms, are used as the silver halide solvent is disclosed. Images obtained by the method are stable during storage over a long period of time.

11 Claims, No Drawings

SILVER HALIDE DIFFUSION TRANSFER USING PLURAL CYCLIC IMIDE SILVER HALIDE SOLVENTS

FIELD OF THE INVENTION

This invention relates to a method for image formation by a silver halide diffusion transfer process and to a film unit used therefor.

BACKGROUND OF THE INVENTION

A method for image formation by diffusion transfer using a silver salt, such as a silver halide, is well known. This method comprises, for example, treating an imagewise light-exposed silver halide emulsion layer with an alkaline aqueous solution containing a developing agent and a silver halide solvent to reduce the light-exposed silver halide grains to silver with the developing agent and to convert the unexposed silver halide grains to a transferable silver complex salt by the silver halide solvent, diffusion-transferring the silver complex salt to a layer containing a silver precipitant (i.e., image-receiving layer) superposed on the aforesaid emulsion layer through inhibition, and reducing the thus transferred silver complex salt to a silver image with the developing agent with the aid of a silver precipitant.

A film unit which can be used in carrying out the above-described diffusion transfer process generally comprises a light-sensitive element comprising a support having provided thereon a light-sensitive silver halide emulsion layer, an image-receiving element comprising a support having provided thereon an image-receiving layer containing a silver precipitant, and a processing element comprising a rupturable container containing an active aqueous alkaline solution containing a developing agent, a silver halide solvent and a thickener. The emulsion layer of the light-sensitive element is imagewise exposed to light. The thus exposed light-sensitive element and the image-receiving element are then superposed on each other in such a manner that the emulsion layer and the image-receiving layer face each other and, in the interim, the processing element is ruptured and the superposed elements are passed through a pair of rollers so that a viscous alkaline aqueous solution is spread therebetween. After a given time has elapsed, the image-receiving element is peeled away from the light-sensitive element to thereby obtain a print having formed a desired image on the image-receiving layer thereof.

In order to improve preservability of the thus formed image for an extended period of time, various proposals have hitherto been made. In particular, U.S. Pat. No. 4,168,166 discloses a method for inhibiting generation of unfavorable crystals or salted-out compositions during storage of color images obtained by additive color photography, which method comprises using a borate compound as a component of a processing solution.

It was found, however, that when such a borate compound is used in a large quantity, generation of crystals or salted-out compositions during storage is sometimes rather accelerated.

SUMMARY OF THE INVENTION

Accordingly, an object of this invention is to provide a novel method for image formation by a silver salt diffusion transfer process.

Another object of this invention is to provide a method for forming an image which is stable during storage for an extended period of time.

The present inventors extensively investigated a method for greatly suppressing generation of crystals or salted-out compositions on the surface of images during storage by means of an additive less dependent upon amounts to be added. As a result, it has now been found that the above-described objects can be accomplished by using at least two cyclic imide compounds.

More specifically, the present invention relates to a method for image formation by a diffusion transfer process comprising developing an imagewise light-exposed light-sensitive silver halide emulsion layer in the presence of a developing agent, a silver halide solvent and an alkali to thereby convert at least a part of unexposed silver halide of the emulsion layer to a transferable silver complex salt and transferring at least a part of the silver complex salt to an image-receiving layer containing a silver precipitant to form a silver image on the image-receiving layer, wherein at least two cyclic imide compounds represented by the following formula (I) are used in combination as the silver halide solvent:

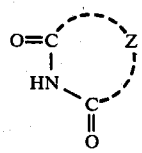

(I)

wherein Z represents an atomic group necessary to form a 5- or 6-membered imido ring containing from 1 to 3 nitrogen atoms.

DETAILED DESCRIPTION OF THE INVENTION

In the above-described formula (I), the imido ring includes those substituted with an amino group, an alkyl group (preferably having from 1 to 4 carbon atoms), a halogen atom, a carboxyl group, an aryl group, or a like group.

The term "amino group" as herein used means an amino group and an amino group substituted with a carboxymethyl group, etc. The term "aryl group" as herein used means an aryl group and an aryl group substituted with an alkyl group of from 1 to 4 carbon atoms, a carboxyl group, a halogen atom, etc.

The cyclic imide compounds used in the present invention are disclosed, for example, in U.S. Pat. Nos. 2,857,274, 2,857,275 and 2,857,276.

In the present invention, two or more of the cyclic imide compounds of the aforesaid formula (I) are used as silver halide solvent, but other conventional silver halide solvents may also be used in combination with these cyclic imide compounds.

Specific examples of the cyclic imide compounds which can preferably be used in the present invention are shown below:

1.

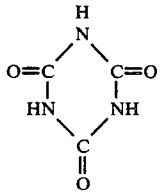

2.

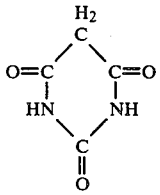

3.

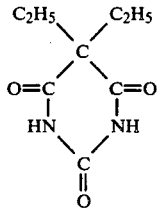

4.

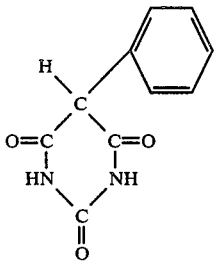

5.

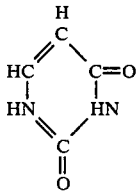

6.

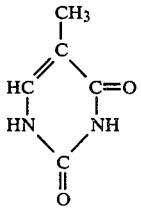

7.

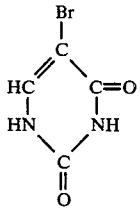

8.

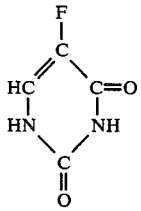

9.

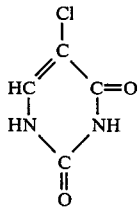

10.

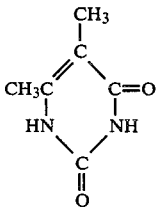

11.

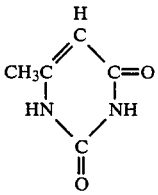

12.

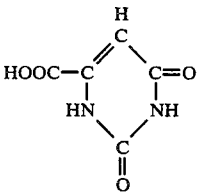

13.

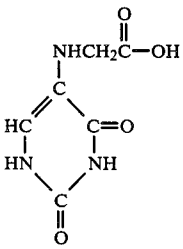

14.

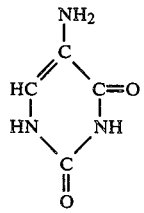

-continued

15.

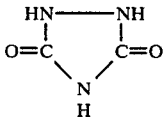

16.

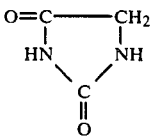

17.

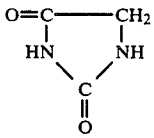

18.

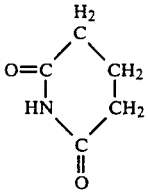

19.

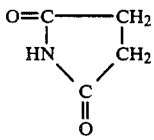

20.

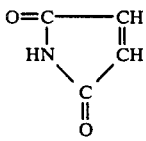

According to the image formation method and film unit of the present invention, a developing agent can be present in either a light-sensitive element or a processing element. The developing agent which can be used in the present invention includes benzene or naphthalene type organic compounds having a hydroxyl group and/or an amino group at the para- or ortho-position thereof, such as hydroquinone, t-butylhydroquinone, p-aminophenol, and the like.

Further, reductic acid as described in U.S. Pat. No. 3,615,440 or $\alpha,\beta$-enediol as described in U.S. Pat. No. 3,730,716 can preferably be used as the developing agent. Furthermore, hydroxylamide developing agents as described in U.S. Pat. Nos. 3,287,125 and 3,293,034 are particularly preferred.

In addition, 1-aryl-3-pyrazolidione compounds described in Japanese Patent Publication No. 13580/74 can be employed in combination with the above-recited developing agents.

Silver halide solvents according to the present invention can be present in a processing element, an image-receiving element, or both.

Alkali agents which can preferably be used for rendering a processing solution alkaline, preferably a pH of 12 or more, include alkali metal hydroxides, for example, sodium hydroxide, potassium hydroxide, lithium hydroxide, and the like.

The cyclic imide compounds according to the present invention can be incorporated in a processing solution and/or an image-receiving layer, but preferably are incorporated in a processing solution.

The amount of the cyclic imide compounds to be used cannot strictly be determined because the amount depends upon the size or form of silver halide grains, the halogen composition or silver amount of silver halides; the kind or amount of the developing agent used; and the capacity of the cyclic imide compound used to dissolve silver halides. However, in the case of industrial production, it is preferable that the cyclic imide compounds are used in a total amount of from 1 to 40 g per 100 g of a processing solution, with the minimum amount of each of the cyclic imide compounds being $1\times10^{-4}$ mol per 100 g of the processing solution. Further, it is preferable that the total amount of the cyclic imide compounds to be incorporated in an image-receiving layer ranges from $5\times10^{-5}$ to $1\times10^{-1}$ mol per $m^2$ of the image-receiving layer, with the minimum amount of each of them being $1\times10^{-5}$ mol per $m^2$ of the image-receiving layer.

The proportion of these cyclic imide compounds also cannot strictly be determined because the proportion depends upon the same factors as described above for the amount. However, in the case of industrial production, it is preferable that each single cyclic imide compound be used at a molar ratio of about 1/100 or more, and more preferably about 1/10 or more, to the total cyclic imide compounds.

The developing agent is usually used in an amount of from $5\times10^{-3}$ to 0.5 mol, preferably from $8\times10^{-3}$ to 0.4 mols, and more preferably from $1\times10^{-2}$ to 0.3 mol, per 100 g of the processing solution.

When it is intended to distribute the processing solution of the present invention as a thin layer between a light-sensitive element and an image-receiving element, it is preferred that the processing solution contains a polymer film-forming agent, a thickening agent or a viscosity-increasing agent. For example, hydroxyethyl cellulose and sodium carboxymethyl cellulose are particularly useful for this purpose. These substances are added to the processing solution at such concentrations that impart an appropriate viscosity in conformity with known principles of a diffusion transfer photographic process.

The processing solution to be used in the present invention can further contain other assistant additives known in silver transfer processes, such as antifoggants, toning agents, stabilizers, and the like. It is especially useful to incorporate oxyethylamino compounds, e.g., triethanolamine, into the processing solution for extending the pot life of the processing solution, as described in U.S. Pat. No. 3,619,185.

The above-described processing solution is preferably placed in a rupturable container to form a processing element. The rupturable container and materials therefor are conventionally known and described in detail in, e.g., U.S. Pat. Nos. 3,056,491, 3,056,492, 3,173,580, 3,750,907, 3,833,381, 4,303,750 and 4,303,751, etc.

The image-receiving element according to the present invention comprises a support bearing a regenerated cellulose layer containing a silver precipitant. The support to be used includes, for example, baryte paper, cellulose triacetate and polyesters. Such an image-receiving element can be prepared by coating a support, which may have provided thereon a subbing layer, if necessary, with a coating solution of an appropriate cellulose ester, e.g., cellulose diacetate, having dispersed therein a silver precipitant, and hydrolyzing the resulting cellulose ester layer with an alkali to convert the cellulose ester to cellulose at least in a part of its depth direction. In a particularly useful embodiment, a part containing the silver precipitant and/or the cellulose ester, e.g., cellulose diacetate, which is present in a lower part of the cellulose ester coating layer and, therefore, has not undergone hydrolysis contains one or more mercapto compounds suitable for improving color tone, stability or other photographic properties of a silver transfer image. Such mercapto compounds are diffused from the position where they have initially been placed during inhibition and utilized. This type of image-receiving element is described in U.S. Pat. No. 3,607,269.

Examples of suitable silver precipitants are heavy metals, such as iron, lead, zinc, nickel, cadmium, tin, chromium, copper and cobalt, and, preferably noble metals, such as gold, silver, platinum and palladium. Other useful silver precipitants include sulfides or selenides of heavy metals, particularly sulfides of mercury, copper, aluminum, zinc, cadmium, cobalt, nickel, silver, lead, antimony, bismuth, cerium and magnesium and selenides of lead, zinc, antimony and nickel. The functions of these silver precipitants in a silver transfer process are described in, e.g., U.S. Pat. No. 2,774,667.

It is preferable to provide an acidic polymer layer for neutralizing the processing solution between the image-receiving layer and the support. The acidic polymer which can preferably be used includes copolymers of unsaturated carboxylic acids, such as acrylic acid, maleic acid, methacrylic acid, itaconic acid, chrotonic acid, etc., acidic cellulose derivatives, and the like. Specific examples of these acidic polymers are a butyl acrylate/acrylic acid copolymer, cellulose acetate/phthalic anhydride copolymer, an ethyl methacrylate/methacrylic acid copolymer, and a methyl methacrylate/-methacrylic acid copolymer. In addition, polymers containing a sulfo group, such as polystyrenesulfonic acid, an acetal obtained from benzaldehydesulfonic acid and polyvinyl alcohol, etc., are also employable.

Further, an intermediate layer is preferably provided between the image-receiving layer and a layer containing a toning agent or a stabilizer. Such an intermediate layer is preferably formed by gun arabic, polyvinyl alcohol, polyacrylamide, and the like.

Furthermore, it is preferable that a parting layer is provided on the surface of the image-receiving layer in order to prevent the processing solution from adhering onto the surface of the image-receiving layer upon peeling the light-sensitive element after development processing. Such a parting layer is preferably formed by gum arabic, hydroxyethyl cellulose, methyl cellulose, polyvinyl alcohol, polyacrylamide, sodium alginate, and those materials disclosed in U.S. Pat. Nos. 3,772,024 and 3,820,999 and British Pat. No. 1,360,653.

In a special embodiment according to the present invention, an image-receiving layer can be integrated in a light-sensitive element as hereinafter described. A preferred example of such an integrated film unit comprises a polyethylene terephthalate sheet having successively formed thereon an image-receiving layer containing a silver precipitant, a light-reflecting layer containing a white pigment, e.g., titanium dioxide, a light-shielding layer containing a light adsorbent, e.g., carbon black, and a light-sensitive silver halide emulsion layer in the order listed. According to this embodiment, since the light-reflecting layer shields the background layers, the image formed on the image-receiving layer after diffusion transfer processing can be observed through the polyethylene terephthalate sheet without peeling off the light-sensitive silver halide emulsion layer.

The light-sensitive element which can be used in the present invention can be obtained by applying a photographic emulsion hereinafter described onto a support.

Silver halides which can be contained in the photographic emulsion according to the present invention may be any of silver bromide, silver iodobromide, silver iodochlorobromide, silver chlorobromide and silver chloride. Preferred silver halides are silver iodobromides or silver iodochlorobromides containing 10 mol% or less of silver iodide. Especially preferred ones are silver iodobromides containing from 3 to 10 mol% of silver iodide.

A mean grain size of silver halide grains in the photographic emulsion (the grain size being defined as grain diameter if the grain has a spherical or a nearly spherical form and as a length of the edge if the grain has a cubic form, and being averaged based on projected areas of the grains) is not particularly restricted, but is preferably 3 μm or less, more preferably 1.5 μm or less, and most preferably from 0.8 to 1.2 μm.

Grain size distribution may be either narrow or broad.

Silver halide grains in the photographic emulsion may have an isometric crystal form such as a cube and an octahedron, an irregular crystal form such as a sphere and a plate, or a composite form thereof. Silver halide grains may be a mixture of grains having various crystal forms.

The individual silver halide grains may comprise a core and an outer shell or may be homogeneous. Further, they may be a surface latent image type in which a latent image is predominantly formed on the surface or an inner latent image type in which a latent image is predominantly formed in the interior thereof. The former type grains are preferred.

It is possible to achieve reduction of the processing time by using silver halide grains of a plate form having a diameter/thickness ratio of 5 or more at a proportion of at least 40% by weight based on the total silver halide grains in the emulsion. In this embodiment, the emulsion layer has a thickness of from 0.5 to 8.0 μm, and preferably from 0.6 to 6 μm, and the coverage of the silver halide grains is from 0.1 to 3 $g/m^2$, and preferably from 0.2 to 1.5 $g/m^2$. A process for preparing the above-described plate silver halide grains is described in Japanese Patent Application No. 14038/83.

Photographic emulsions employed in the present invention can be prepared according to conventional methods as described in, e.g., P. Glafkides, *Chimie et Physique Photographique*, Paul Montel, Paris (1967) G. F. Duffin, *Photographic Emulsion Chemistry*, The Focal Press, London (1966), V. L. Zelikman et al., *Making and Coating Photographic Emulsion*, The Focal Press, London (1964), and the like. That is, photographic emulsions can be prepared by any of the acid process, the neutral process, the ammonia process, and the like; and methods for reacting a water-soluble silver salt with a water-soluble halide may be any of a single jet method, a double jet method and a combination thereof.

In addition, a method in which silver halide grains are produced in the presence of excess silver ions (the so-called reverse mixing method) can also be employed. Further, the so-called controlled double jet method, in which the pAg of the liquid phase wherein silver halide grains are to be formed is maintained constant, may be employed. According to this method, silver halide grains having a regular crystal form and an almost uniform size distribution can be obtained.

Two or more silver halide emulsions prepared separately may be used in the form of a mixture.

In the formation or physical ripening of silver halide grains, cadmium salts, zinc salts, lead salts, thallium salts, iridium salts or complex salts thereof, rhodium salts or complex salts thereof, iron salts or complex salts thereof, and the like may be present in the system.

After the formation or physical ripening of silver halide grains, soluble salts are usually removed from the emulsion by a conventionally known noodle washing process comprising gelling gelatin or by a sedimentation (flocculation) process using an inorganic salt having a polyvalent anion (e.g., sodium sulfate), an anionic surface active agent, an anionic polymer (e.g., polystyrenesulfonic acid) or a gelatin derivative (e.g., aliphatic acylated gelatin, aromatic acylated gelatin, etc.). The step for removing soluble salts may be omitted.

Silver halide emulsions may be used as the so-called primitive emulsions which are not subjected to chemical sensitization, but it is usual for the silver halide emulsion to be chemically sensitized. Chemical sensitization can be carried out using processes as described in, e.g., the above-cited references by Glafkides, Duffin or Zelikman et al., or H. Frieser (ed.), *Die Grundlagen der Photographischen Prozesse mit Silberhalogenid Emulsionen*, Akdemische Verlagsgesellschaft (1968).

Photographic silver halide emulsions which can be used in the present invention can contain anti-foggants or stabilizers. Specific examples of these additives are described in *Product Licensing Index*, Vol. 92, p107, "Antifoggants and stabilizers".

The photographic emulsions can contain a developing agent. Specific examples of the developing agents which can be used are those described in *Product Licensing Index*, Vol. 92, pp. 107–108, "Developing agents".

Silver halide grains can be dispersed in a colloid capable of being hardened with an organic or inorganic hardener. The hardeners which can be used include those described in *Product Licensing Index*, Vol. 92, p. 108, "Hardeners".

The silver halide emulsions can contain a coating aid. The coating aids which can be used include those described in *Product Licensing Index*, Vol. 92, p. 108, "Coating aids".

Photographic emulsions used in the present invention can further contain an antistatic agent, a plasticizer, a fluorescent brightening agent, an air fog preventing agent, and the like.

Vehicles of the silver halide emulsions used in the present invention include those described in *Product Licensing Index*, Vol. 92, p. 108, "Vehicles" (December, 1971).

The silver halide emulsion is coated on a support, if necessary, together with other photographic layers in accordance with the coating methods as described in *Product Licensing Index*, Vol. 92, p. 109, "Coating procedures". The support which can be used includes those described in *Product Licensing Index*, Vol. 92, p. 108, "Supports".

The photographic emulsion of the present invention may contain, for example, polyalkylene oxides or derivatives thereof, e.g., ethers, esters and amines thereof, thioether compounds, thiomorpholines, quaternary ammonium salt compounds, urethane derivatives, urea derivatives, imidazole derivatives, 3-pyrazolidones, and the like for the purpose of increasing sensitivity or contrast or accelerating the development. Examples of such compounds are disclosed in, e.g., U.S. Pat. Nos. 2,400,532, 2,423,549, 2,116,062, 3,617,280, 3,772,021 and 3,808,003, etc.

The photographic emulsion layers or other hydrophilic colloidal layers of the light-sensitive element prepared by the present invention can contain water-soluble dyes as a filter dye or for various purposes including prevention of irradiation. Such water-soluble dyes include oxonol dyes, hemioxonol dyes, styryl dyes, merocyanine dyes, cyanine dyes and azo dyes. Of these, oxonol dyes, hemioxonol dyes and merocyanine dyes are particularly useful. These dyes may be fixed to a specific layer by mordants, such as cationic polymers, e.g., dialkylaminoalkyl acrylate, etc.

When the hydrophilic colloidal layers of the light-sensitive element prepared according to the present invention contain dyes or ultraviolet absorbents, they may be fixed in a layer with cationic polymer mordants, such as the polymers described in British Pat. No. 685,475, U.S. Pat. Nos. 2,675,316, 2,839,401, 2,882,156, 3,048,487, 3,184,309 and 3,445,231, West German Patent Application (OLS) No. 1,914,362, Japanese Patent Application (OPI) No. 47624/75 and 71332/75, etc.

Light-exposure for obtaining a photographic image is carried out in a usual manner using any known light sources including natural light (sunlight), a tungsten lamp, a fluorescent lamp, a mercury lamp, a xenon arc lamp, a carbon arc lamp, a xenon flash lamp, a cathode ray tube flying spot, and the like.

Suitable exposure times which can be used include not only exposure times commonly used in cameras ranging from about 1/1,000 at about 1 second, but also exposure times shorter than 1/1,000 second, for example, from $1/10^4$ to $1/10^6$ second as with zenon flash lamps and cathode ray tubes. Exposure times longer than 1 second can also be used. The spectral composition of the light employed for the exposure can be controlled by using color filters, if desired. Laser beams can also be used for exposure. Moreover, exposure may also be effected with light emitted from fluorescent substances excited by electron beams, X-rays, $\gamma$-rays, $\alpha$-rays, and the like.

Details for the methods of arrangement and combination of the above-described light-sensitive element, image-receiving element and processing element to form film units are described in, e.g., Neblettés, *Handbook of Photography and Reprography,* 7th Ed., pp. 282–285. For a particularly preferred embodiment of the film unit, reference can be made to U.S. Pat. No. 3,350,991.

Thus, in accordance with the present invention, a combined use of two or more cyclic imide compounds of the formula (I) makes it possible to preserve images for a long period to time, and particularly to prevent crystallization on the image surface.

The present invention will now be illustrated in greater detail with reference to examples, but it should be understood that these examples are not limiting the present invention.

Unless otherwise specified, all ratio, percents, etc. are by weight.

EXAMPLE 1

Preparation of Light-Sensitive Sheet

Silver halide grains were formed by a single jet method, physically ripened in a usual manner, subjected to desalting, and chemically ripened to obtain a silver iodobromide emulsion (iodine content: 5.5 mol%). The resulting emulsion contained 0.65 mol of silver halide per Kg, and the silver halide grains contained therein had a mean diameter of 0.9 $\mu$m. One killogram portions of the emulsion were placed in pots and dissolved in a thermostat at 50° C.

To each of the pots were added 10 ml of a 1 wt% aqueous solution of an ortho sensitizing dye (3-{5-chloro-2-[2-ethyl-3-(3-ethyl-2-benzothiazolinylidene)-propenyl]-3-benzoxazolio}propane-sulfonate), panchro sensitizing dye (4-{2-[3-ethylbenzothiazolin-(2-ylidene)-2-methyl-1-propenyl]-3-benzothiazolio}propane-sulfonate) and 4-hydroxy-6-methyl-1,3,3a,7-tetrazaindene, 10 ml of a 1 wt% aqueous solution of 2-hydroxy-4,6-dichlorotriazine sodium salt, 10 ml of a 1 wt% aqueous solution of sodium dodecylbenzenesulfonate, and 10 ml of a 0.1 wt% methanolic solution of lipoic acid, and the resulting mixture was stirred at 40° C. The thus prepared emulsion was coated on a polyethylene terephthalate film base containing titanium dioxide and having been subjected to a subbing treatment so as to result in a dry film thickness of 3 $\mu$m, followed by drying to prepare a sample. At the same time, a gelatin aqueous solution containing a polymethyl methacrylate latex having a mean particle size of 3.5 $\mu$m was also coated thereon to a dry film thickness of 1 $\mu$m. The silver coverage of the resulting sample was 0.5 g/cm$^2$.

Preparation of Image-Receiving Sheet

A polyethylene laminate paper having a 6 $\mu$m thick cellulose triacetate layer was immersed in an alkaline hydrolysis solution containing a silver precipitant for 1 minute to prepare an image-receiving sheet for diffusion transfer.

The alkaline hydrolysis solution was prepared as follows. In 2 ml of water was dissolved 0.1 g of nickel nitrate, and the solution was added to 100 ml of glycerin. While vigorously stirring, 1 g of sodium sulfide dissolved in 2 ml of water was added thereto to prepare a silver precipitant dispersion of nickel sulfide. 20 ml of the dispersion was added to 1,000 ml of water-methanol (1:1 by volume) solution containing 80 g of sodium hydroxide to prepare an alkaline hydrolysis solution containing a silver precipitant.

Preparation of Processing Solution

The cyclic imide compounds shown in Table 1 were added to Processing Solution A having the following composition, and water was added thereto to make 2 Kg.

| Composition of Processing Solution A: | |
|---|---|
| Potassium hydroxide (40% aqueous solution) | 323 ml |
| Titanium dioxide | 3 g |
| Hydroxyethyl cellulose | 79 g |
| Zinc oxide | 9.75 g |
| N,N—Bismethoxyethylhydroxylamine | 75 g |
| 40% Aqueous solution of Triethanolamine | 17.14 g |
| Tetrahydropyrimidinethione | 0.4 g |
| 2,4-Dimercaptopyrimidine | 0.35 g |
| 6-n-Propylthiouracil | 0.35 g |

The resulting processing solution was spread between the above-described light-sensitive sheet and image-receiving sheet. After 5 minutes, the two sheets were separated.

The amounts of the cyclic imide compounds indicated in Table 1 had previously been determined so that all the resulting images obtained in Run Nos. 2 to 7 were substantially equal to the image obtained in Run No. 1 in terms of sensitivity, gradient, maximum density, minimum density and time required for image formation.

Each of the resulting images was allowed to stand at room temperature for 1 week to evaluate the surface condition of the image. the results obtained are shown in Table 1.

TABLE 1

| Run No. | Cyclic Imide Compound | (Amount) | Surface Condition of Image |
|---|---|---|---|
| 1 | uracil | (90 g) | crystallization on the entire surface |
| 2 | 6-methyluracil | (110 g) | crystallization on the entire surface |
| 3 | 5-methyluracil | (110 g) | crystallization on the entire surface |
| 4 | uracil<br>6-methyluracil | (45 g)<br>(51 g) | crystallization on a small part of the surface |
| 5 | uracil<br>6-methyluracil<br>5-methyluracil | (45 g)<br>(30 g)<br>(20 g) | no crystallization |
| 6 | uracil<br>5-bromouracil | (45 g)<br>(77 g) | no crystallization |
| 7 | uracil<br>6-methyluracil<br>hydantoin | (45 g)<br>(30 g)<br>(18 g) | no crystallization |

The results of Table 1 proved that the combined use of two or more cyclic imide compounds according to the present invention suppresses crystallization on the surface of an image during preservation of the image without adversely affecting image formation.

Additionally, the surface of the image immediately after separation of two sheets was also observed, but no crystals were found in each case.

EXAMPLE 2

Preparation of Image-Receiving Sheet

Onto a polyethylene laminate paper was applied a solution of 18 g of cellulose acetate (acetylation degree: 54%) and 12 g of styrene-maleic anhydride copolymer in a mixed solvent comprising 270 ml of acetone and 30 ml of methanol to a thickness of 54 ml/m$^2$, followed by drying. Then, a 10% cellulose acetate acetone solution of 3,6-diphenyl-1,4-dimercapto-3H,6H-2,3a,5,6a-tetrazapentalene (0.05 g/m$^2$) was applied thereonto to a dry film thickness of 5 g/m$^2$. A 5% aqueous solution of polyacrylamide having incorporated therein a 5% aqueous solution of dimethylolurea and a 50% aqueous solution of acetic acid at concentrations of 5% and 1.25%, respectively, was further coated thereon to a coverage of 25 ml/m$^2$. Furthermore, a fine dispersion of palladium sulfide in an acetone-methanol solution of cellulose acetate prepared as described below was coated thereon. This dispersion contained 1-phenyl-5-mercaptoimidazole in such an amount to give a coverage of $1.25\times10^{-6}$ mol/m$^2$. The resulting coating had a dry thickness of 0.8 $\mu$m. The coated unit was furthermost coated with an alkaline solution (a 0.28M potassium hydroxide solution in methanol/water (8:2 by volume)) to a coverage of 18 ml/m$^2$, washed with water, and dried to thereby obtain an image-receiving sheet. The aforesaid fine dispersion of palladium sulfide was prepared by thoroughly stirring a mixture of a 5.3% solution of cellulose acetate in an acetone-methanol mixed solvent, a $7\times10^{-3}$M solution of sodium sulfide in methanol, and a $7\times10^{-3}$M solution of sodium palladium chloride in methanol.

Processing Solution A as used in Example 1 having incorporated therein the silver halide solvent shown in Table 2 was spread between the above-prepared image-receiving sheet and the same light-sensitive sheet as prepared in Example 1, and the image-receiving sheet was then peeled away. The image formed on the image-receiving sheet was allowed to stand at room temperature for 1 week to observe the surface condition thereof. The results obtained are shown in Table 2.

TABLE 2

| Run No. | Silver Halide Solvent | (Amount) | Surface Condition of Image |
|---|---|---|---|
| 1 | uracil +<br>6-methyluracil | (81.8 g)<br>(9.2 g) | substantially no crystal precipitation |
| 2 | uracil | (90 g) | generation of crystals on the entire surface |

It can be seen from Table 2 that a combined use of two cyclic imade compounds according to the present invention can provide excellent transfer images substantially free from crystallization on the surfaces thereof.

While the invention has been described in detail and with reference to specific embodiments thereof, it will be apparent to one skilled in the art that various changes and modifications can be made therein without departing from the spirit and scope thereof.

What is claimed is:

1. A method for image formation by a diffusion transfer process comprising developing an imagewise light-exposed light-sensitive silver halide emulsion layer in the presence of a developing agent, a silver halide solvent and an alkali to thereby convert at least a part of unexposed silver halide of the emulsion layer to a transferable silver complex salt and transferring at least a part of the silver complex salt to an image-receiving layer containing a silver precipitant to form a silver image on the image-receiving layer, wherein at least two cyclic imide compounds represented by the following formula (I) are used as the silver halide solvent:

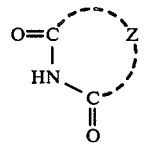

wherein Z represents an atomic group necessary to form a substituted or unsubstituted 5- or 6-membered imido ring containing from 1 to 3 nitrogen atoms, where when the imido ring formula (I) is substituted it is substituted with an unsubstituted amino group, an alkyl group, a halogen atom or a carboxyl group and wherein each of the cyclic imide compounds is used at a molar ratio of about 1/100 or more to the total cyclic imide compounds.

2. A method as claimed in claim 1, wherein the alkyl group has from 1 to 4 carbon atoms.

3. A method as claimed in claim 1, wherein the cyclic imide compounds are present in a processing solution and/or an image-receiving layer.

4. A method as claimed in claim 1, wherein the cyclic imide compounds are present in a processing solution in an amount of from 1 to 40 g per 100 g of the processing solution, with the minimum amount of each of the cyclic imide compounds being $1\times10^{-4}$ mol per 100 g of the processing solution.

5. A method as claimed in claim 1, wherein the cyclic imide compounds are present in an image-receiving layer in an amount of from $5\times10^{-5}$ to $1\times10^{-1}$ mol per m$^2$ of the image-receiving layer, with the minimum amount of each of the cyclic imide compounds being $1\times10^{-5}$ mol per m$^2$ of the image-receiving layer.

6. A method as claimed in claim 1, wherein each of the cyclic imide compounds is used at a molar ratio of about 1/10 or more to the total cyclic imide compounds.

7. A method as claimed in claim 6, wherein the cyclic imide compounds are present in a processing solution in an amount of from 1 to 40 g per 100 g of the processing solution, with the minimum amount of each of the cyclic imide compounds being $1\times10^{-4}$ mol per 100 g of the processing solution.

8. A method as claimed in claim 3, wherein the cyclic imide compounds are present in an image-receiving layer in an amount of from $5\times10^{-5}$ to $1\times10^{-1}$ mol per $m^2$ of the image-receiving layer, with the minimum amount of each of the cyclic imide compounds being $1\times10^{-4}$ mole per 100 g of the processing solution.

9. The method of claim 1, wherein the compounds of formula (I) contain two nitrogen atoms in the ring thereof.

10. The method of claim 1, wherein three of said cyclic imide compounds are used as the silver halide solvent.

11. The method of claim 1, wherein said at least two cyclic imide compounds are selected from the group consisting of unsubstituted uracils, alkyl-substituted uracils and halogen-substituted uracils.

* * * * *